US006763811B1

(12) United States Patent
Tamol, Sr.

(10) Patent No.: US 6,763,811 B1
(45) Date of Patent: Jul. 20, 2004

(54) METHOD AND APPARATUS TO ENHANCE COMBUSTION OF A FUEL

(75) Inventor: Ronald A. Tamol, Sr., Midlothian, VA (US)

(73) Assignee: Ronnell Company, Inc., Richmond, VA (US)

( * ) Notice: Subject to any disclaimer, the term of this patent is extended or adjusted under 35 U.S.C. 154(b) by 0 days.

(21) Appl. No.: 10/340,246

(22) Filed: Jan. 10, 2003

(51) Int. Cl.[7] ..... F02M 33/00
(52) U.S. Cl. ..... 123/536; 123/538
(58) Field of Search ..... 123/538, 537, 123/536; 210/222, 695; 239/690; 725/111

(56) References Cited

U.S. PATENT DOCUMENTS 3,597,668 A * 8/1971 Yoshimine ..... 361/225
4,048,963 A 9/1977 Cottell
4,052,139 A 10/1977 Paillaud et al.
4,188,296 A 2/1980 Fujita
4,347,825 A 9/1982 Suzuki et al.
4,401,089 A 8/1983 Csaszar et al.
4,429,665 A * 2/1984 Brown ..... 123/3
4,605,523 A 8/1986 Smillie
4,672,938 A 6/1987 Hoppie et al.
4,879,045 A 11/1989 Eggerichs
5,044,347 A * 9/1991 Ullrich et al. ..... 123/538
5,092,760 A 3/1992 Brown et al.
5,129,382 A 7/1992 Stamps, Sr. et al.
5,159,915 A 11/1992 Saito et al.
5,234,170 A * 8/1993 Schirmer et al. ..... 239/690
5,307,779 A * 5/1994 Wood et al. ..... 123/538
5,313,123 A 5/1994 Simuni
5,507,267 A 4/1996 Stuer
5,992,398 A 11/1999 Ho
6,244,254 B1 * 6/2001 Chen ..... 123/536
6,264,899 B1 7/2001 Caren et al.
6,386,187 B1 * 5/2002 Phykitt ..... 123/538
6,488,016 B2 * 12/2002 Kavonius ..... 123/538
6,550,460 B2 * 4/2003 Ratner et al. ..... 123/538

* cited by examiner

*Primary Examiner*—Marguerite McMahon
(74) *Attorney, Agent, or Firm*—John H. Thomas, P.C.

(57) ABSTRACT

The present invention relates to alternatively using magnetic or electric field devices to enhance combustion. More particularly, the present invention relates to alternatively using magnetic or electric field devices to enhance combustion and treat the corresponding products of combustion to increase fuel efficiency and reduce exhaust pollutants.

8 Claims, 1 Drawing Sheet

METHOD AND APPARATUS TO ENHANCE COMBUSTION OF A FUEL

FIELD OF THE INVENTION

The present invention relates to alternatively using magnetic or electric field devices to enhance combustion. More particularly, the present invention relates to alternatively using magnetic or electric field devices to enhance combustion and treat the corresponding products of combustion to increase fuel efficiency and reduce exhaust pollutants.

BACKGROUND

Pre-combustion Treatment

One method attempting to increase engine fuel efficiency has been to treat the fuel prior to entering the combustion chamber with a magnetic field. Treatment of fuel includes placing magnets onto or within the fuel supply line. U.S. Pat. Nos. 4,572,145, 4,188,296 and 5,129,382 describe magnets being attached to the fuel line. A fuel in-line magnetic field treatment static mixer device is cited in U.S. Pat. No. 4,519,919. U.S. Pat. No. 4,188,296 notes that oil fuel is magnetizable and if an oil burner nozzle is magnetizable, it will be magnetized by the treated oil fuel.

The use of an electric field to treat the fuel is described in U.S. Pat. No. 4,373,494, where electrodes provide a high intensity electric field surrounding a bed of dielectric beads for treatment of fuel flowing between electrodes prior to entering the combustion chamber. U.S. Pat. No. 5,507,267 claims feasibility of coating the many engine components via the air inlet conduit with organic electret materials in a solvent.

Pre-combustion Treatment-Injector Nozzles

U.S. Pat. No. 5,159,915 describes one magnetic treatment utilizing a fuel injector that heats fuel to be injected by an electromagnetic coil. U.S. Pat. No. 4,051,826 describes electrically charging the fuel tube and nozzle to a high electrical potential to charge fuel droplets. U.S. Pat. No. 4,347,825 also describes using a high voltage ring shaped electrode that encircles the injected fuel to electrify fuel particles to prevent them from attaching to the surrounding walls with a second field impressed on the cylinder walls to prevent attachment. U.S. Pat. No. 5,507,267 claims an electrically polarizable material such as an organic electret material in a solvent, can be sprayed over a charged plate and drawn into the engine through an air intake conduit while coating the surfaces it contacts. Later, the resulting solid film becomes polarized as it dries.

Pre-combustion Air Treatment or Fuel/Air Mixture Treatment

The air and fuel mixture in an atomizing fuel chamber is treated by a focused magnetic field as described in U.S. Pat. No. 6,178,953. U.S. Pat. No. 4,460,516 discusses using permanent magnets to treat an air fuel mixture in a duct. U.S. Pat. No. 4,188,296 describes fuel, steam and air in an oil burner being treated by a magnetic field. U.S. Pat. No. 5,977,716 describes using a high voltage to ionize air between electrodes.

In-cylinder Combustion Enhancement

U.S. Pat. No. 4,176,637 describes using an electrode that surrounds a nozzle within the combustion chamber to charge the fuel by an electric field. U.S. Pat. No. 5,507,267 claims a charged electret material can be deposited on parts such as valves or a fuel injector within the combustion chamber resulting in an electric field that comes in contact with reactants in the cylinder prior to and during combustion.

Exhaust Stream Treatment

U.S. Pat. No. 6,264,899 describes using an externally powered electric discharge device or an externally powered dielectric discharge device to produce hydroxyl radicals injected into the exhaust stream to reduce pollutants. U.S. Pat. No. 5,893,267 discusses a non-thermal plasma gas treatment combined with a selective catalytic reduction device to reduce the NOx pollutant. A corona generating wire supplies the non-thermal plasma treatment. Several articles in the published literature explain the use of non-thermal electric field treatment using corona discharge or other powered electric field generating devices to produce an electric field in the exhaust stream to assist the catalytic converter in further reducing pollutant gases.

Despite the numerous inventions addressing this problem, there still exists a need for improved enhancement of combustion. The present invention embodies novel configurations to maximize combustion

OBJECTS OF THE INVENTION

One object of the invention is to provide a method and apparatus to apply either magnetic or electric fields to enhance combustion of fuels to obtain more complete combustion resulting in improved combustion efficiency in internal or external combustion devices.

Another object of the invention is to provide a method and apparatus to reduce the formation of exhaust pollutants.

Still another object of the invention is to combust any remaining pollutants that exist in the exhaust stream.

Yet another object of the invention is to provide an apparatus that can easily and economically be retrofitted to existing internal combustion engines and external combustion devices to accomplish the several advantages of the invention.

SUMMARY OF THE INVENTION

These and other objectives are met by use of the present method and apparatus. The present invention treats the fuel stream by placing a configuration within the fluid feed section, wherein said configuration may be either a magnetic field component or an electric field component. Said configuration may have a fluted wall forming a small annular space between the configuration and the fuel pipe wall, whereby a thin film of fuel is forced through this space. Alternatively, the configuration may be a porous filter-like component of magnetic construction. The fuel may also be treated by an improved fuel feed nozzle made from a permanent magnet or at least two metals that exhibit a standard potential difference.

The air stream is treated by placing a configuration within the air stream conduit wherein said configuration may be either a magnetic field component or two metals that exhibit a standard potential difference, thereby creating an electric field. Said magnetic field component configuration may be in the form selected from the group consisting of parallel magnetic plates, magnetically coated honeycomb grid and a mesh of magnetic material filled fibers. Said electric field configuration may be in the form of closely spaced opposite parallel plates of metal pairs such as copper and aluminum.

The in-cylinder combustive mixture is treated by placing either a magnetic or electric field component onto a spark plug. Furthermore, the in-cylinder combustive mixture is treated by placing a magnetic field component within the combustion chamber.

The exhaust system is treated by placing a configuration having a magnetic or electric field component within the exhaust gas return (EGR) conduit and/or before the catalytic converter. Said electric component may be an electret or two metals that exhibit a standard potential difference, thereby creating an electric field. Said configuration may be in the form of parallel plates, coated honeycomb or fibers.

DESCRIPTION OF THE PREFERRED EMBODIMENTS

The Fuel Stream

Figure 1:
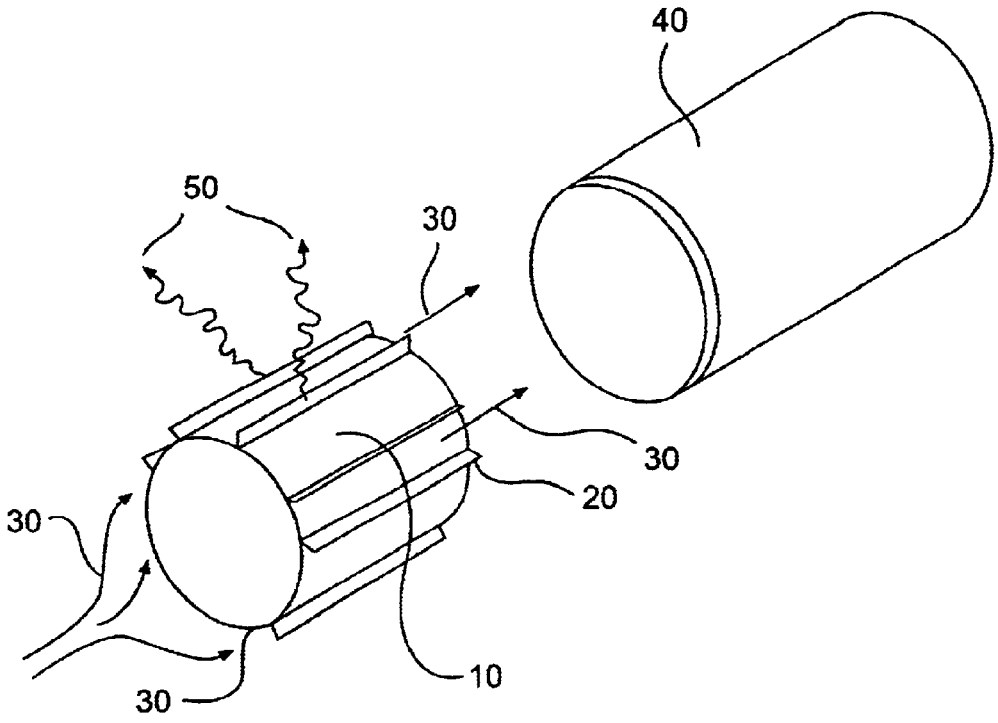
FIG. 1 is an exploded view of a fluted design magnetic or electric field component that can be inserted within a fuel line or body section of an injector. The component forces the fuel flow toward its periphery forming a thin film of fluid between the component and the wall, subjecting the fuel film to a maximum field strength treatment.
Figure 2:
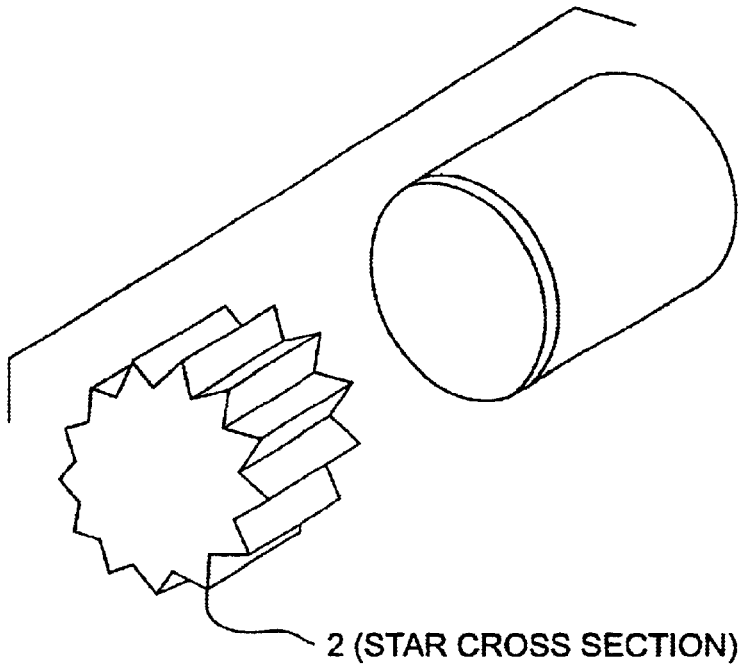
FIG. 2 is an exploded view of a magnetic or electric field component consisting of a multi-star edged design that can be inserted within a fuel line or body section of an injector forcing the fuel flow toward its periphery forming a thin film of fluid between the component and the wall subjecting the fuel film to a maximum field strength treatment.

It is desirable to submit the fuel prior to combustion to the highest magnetic or electric field possible to alter its molecular makeup. The goal in this treatment stage is to create the highest percentage of free radical or other reactive molecular species within the fuel. This high field strength treatment can best be obtained by subjecting a thin film of fuel to either a magnetic or electric field. One location is in the fuel line. Referring to FIG. 1, in one embodiment, a permanent magnetic or electric field component 10 with a fluted wall 20 is placed within the fuel line 40 a small annular space through which a thin film of fuel 30 is forced to flow. The magnetic field component may be a permanent magnet segment. Said permanent magnet may have a high radial magnetic field strength 50 such as that created by a rare earth permanent magnetic material and may subject the thin fuel film to a very high magnetic field treatment. FIG. 2 shows an alternative multifaceted star cross-section with the same relationship of fuel flow and field direction as shown in FIG. 1.

In another embodiment, a method of creating an electric field for fuel treatment is accomplished by directing the fuel stream, between two dissimilar, short-circuited metals such as copper and aluminum. The electric field effect occurs due to the existence of standard potential differences between metals. The fuel flows between the two metals such as copper and aluminum and is treated by the electric field created by the potential difference of the metal pair. The desirable thin fuel stream and associated high field treatment within the fuel line could also be located and created within the inlet section of the fuel injector body itself.

Another method to obtain a very thin fuel path would be that of fabricating a fuel filter-like element from a magnetic or electret material. Fuel filters are able to filter-out solid materials in the 6–20 micron range. It follows that the fuel path is also subjected to a flowing fuel thickness of the same dimension range. A similar porous filter configuration could be made of materials such as a high strength rare earth permanent magnet or a high field strength electret, either of sintered particle or polymer bonded construction. This configuration would provide an almost end point treatment of a thin liquid film to a maximum field strength.

The fuel stream can also be treated by a nozzle section that produces a magnetic field that acts on the fuel just before and after the fuel exits the nozzle. This nozzle section may be made from a high field strength magnetic material such as a rare earth magnetic material with the direction of field orientation being in the longitudinal direction. This magnetic field may be projected into the combustion chamber in a direct fuel injection Diesel Compression Ignition Engine (CI), and into the intake manifold in a Spark Ignition Engine (SI). The magnetic field producing materials of the invention are able to withstand temperatures encountered in the internal engine combustion process. Another embodiment for creating an enhancing field treatment consists of segmented magnetic inserts or coatings. They could be applied to the internal and/or external surface of the injector nozzle.

An electric field can also be produced by locating two dissimilar metals such as copper and aluminum as an insert segment in the internal and/or the external surface of the fuel injector nozzle. Inserts on the external surface of a nozzle would produce an electric field along axis of the injector and the resulting field will emanate into the cylinder of the CI engine or into the intake manifold in the SI engine and treat the fuel as it is injected into the cylinder.

The Air Stream

A magnetic material of high field strength may be incorporated into the air supply conduit of either a CI or SI internal combustion engine. The magnetic field acts on the air stream and its water constituent to create ions and free radicals. The magnetic field can best be supplied by a configuration that segments the air stream into flow patterns that are subjected to a maximum magnetic field strength. Such embodiments include using high field strength permanent magnetic materials consisting of designs such as multiple parallel magnetic plates, a magnetically coated honeycomb grid, and a mesh of magnetic material filled fibers. When used in conjunction with a magnetic field treated fuel supply, it is desirable to have the polarity of the magnet to be of opposite polarity to that of the fuel treatment magnet.

One method of creating an electric field can be accomplished with two metals such as copper and aluminum in contact with one another. The electric field effect occurs due to the existence of a standard potential difference between metals. One configuration would be to have closely spaced opposite parallel plates of metal pairs such as copper and aluminum producing an electric field through which the air stream passes.

The In-cylinder Combustive Mixture

In addition to treating the fuel as it exits the nozzle, the injector fields, either magnetic or electric that emanate into the cylinder in the direct injection CI engine, will also treat the fuel air mixture in two stages. The first stage is that of a non-thermal plasma treatment, followed by a high temperature plasma treatment as combustion begins and progresses to completion. The treatment of the fuel air mixture within the cylinder in the SI engine can be achieved by adding either a magnet or electret material segment to the spark plug body section that projects, either a magnetic or electric field into the cylinder. Either field emanating into the mixture will create similar treatment by a non-thermal plasma and progressing to a thermal plasma treatment stage as combustion progresses in the SI engine as is the case for the permanent magnet injector nozzle for the CI engine design mentioned above.

The Exhaust Stream

The first exhaust stream to be treated is the exhaust gas return (EGR) stream that is returned to the combustion cylinder in both the newer CI and existing SI engine. For magnetic field treatment, the same configuration used to treat air in the air supply conduit can be used for the EGR conduit, except that the magnetic material must be able to withstand the higher exhaust gas temperature.

An electric field treatment can be produced by an electret configuration of parallel plates, electret material coated honeycomb, or electret fibers, that are placed within the EGR conduit. An electric field due to the potential difference of metal pairs can also be produced and utilized. Metal pairs such as copper and aluminum can also be used in a parallel plate configuration like the one in the air supply treatment previously discussed.

The second exhaust stream to be treated is the main exhaust stream that exits via the exhaust conduit into the catalytic converter, as is the case for the SI engine or future CI engine configurations. For the existing non-catalytic CI exhaust stream, it can also be treated by either a permanent magnet that emanates a magnetic field, or an electret that emanates an electric field into the exhaust stream entering the sound muffler. For magnetic field treatment, a high field strength permanent magnet configuration can be used as in the EGR stream. Permanent magnetic materials that can withstand exhaust gas temperatures are used. For electric field treatment, high temperature resistant organic or inorganic electret materials capable of withstanding exhaust gas temperatures are used. Metal pairs such as copper and aluminum that create an electric field can be used in the same configuration as that of the EGR stream treatment previously discussed.

Materials

As discussed herein, an electret may be a polymer. Polymers may be selected from the group consisting of polymethyl methacrylate, polyvinylchloride, polytetrafluorethylene, polyethylene terathlate, polystyrene, polyethylene, polypropylene, polycarbonate, polysulfone, polyamides, polymethylsiloxane, polyvinylfloride, polytriflurochlorodethylene, polyvinylidine chloride, epoxide resin, polyphenyleneoxide, poly-n-xylene and polyphenylene. Alternatively, the electret may be an inorganic material. Inorganic materials may be selected from the group consisting of titanates of alkali-earth metals ($MgTiO_3$), $CaTiO_3$, $ZnTiO_3$, etc., aluminum oxide ($AlO_3$), silicon dioxide ($SiO_2$), silicon dioxide/silicon nitride, pirex glass, molten quartz, borosilicate glass, and porcelain glass.

The preferred device of the invention to provide magnetic fields is the permanent magnet. Permanent magnet materials consist of material compositions exhibiting magnetic field strength over a wide range. Physical properties such as strength and brittleness also run through a wide range. Another important property of magnets is their allowable operating temperature. As temperature is increased, a temperature (Currie temperature) is reached where magnetization is lost. Most of these characteristics must be taken into account when applying these devices to this invention. Electromagnets could also be used but they have the disadvantage of requiring a power source.

Permanent magnet materials applicable to this invention are the usual commercial grade magnets including Ferrites, Alnico, Samarium-cobalt, and Neodymium-iron-boron.

Application of the Invention to a CI Direct Injection Internal Combustion Engine The pre-combustion fuel treatment may be applied at two sections of the fuel injector. As shown in FIG. 1, the first section is the fuel inlet section of the injector which may have a permanent magnet segment 10 with a fluted wall 20 that directs a thin film of fuel 30 between the magnetic segment 10 and the injector wall 40. In one embodiment, the permanent magnet section is made from Samarium Cobalt, a rare earth permanent magnet material, with a residual induction of 4400 Gauss and a radial direction field 50 and is perpendicular to the fuel flow stream 20. The Curie temperature of this material is above that to which the injector and the magnet segment will be subjected. A resulting very high magnetic field strength in the radial direction 50 will treat the thin cross section fuel stream creating ions and free radicals that are the first stage of the enhanced combustion process. FIG. 2 shows an alternative multifaceted star cross-section design with the same relationship of fuel flow and field direction as explained under FIG. 1.

In another embodiment, the fuel stream enters a nozzle-orifice section comprising an insert of two dissimilar metals, copper and aluminum located in the internal orifice of the injector nozzle. The injector nozzle itself may be made of a Samarium-Cobalt rare earth magnetic material for a second stage of fuel treatment. The electric field emanated by the dissimilar metals will treat the internal nozzle fuel flow stream with an electric field prior to injection as well as treating fuel particles as they are immediately injected into the cylinder. The Samarium Cobalt nozzle will have fuel droplet dispersion orifices similar to a standard nozzle orifice diameter and configuration. The magnetic nozzle will project a magnetic field along its longitudinal axis through the sprayed fuel particles and into the cylinder. The Samarium Cobalt magnetic material has a Currie point of 600° F. This temperature is higher than that encountered by the nozzle under the cooled combustion cylinder condition in an internal combustion engine and will therefore retain its magnetic field properties. The magnetic field emanating into the cylinder provides an in-cylinder combustion treatment creating a homogeneous fuel/air mixture.

The pre-combustion electric field air supply treatment may be applied in the air supply conduit by two dissimilar metals formed into a series of two parallel plates. In one embodiment, the plates are made of copper and aluminum, respectively, of close proximity. The air treatment design will subject the air and its water component to a flow path that subjects them through the maximum electric field strength.

The exhaust stream of the CI engine may be treated at two locations. Newest Diesel Engine designs will lower the oxides of nitrogen (NOx) pollutant by incorporating an EGR stream. In one embodiment, the treatment element is made of fibers in a filter-like structure made from polyphenylene polymer electret fibers. This electret polymer can withstand temperatures of 932 degrees Fahrenheit, a temperature above that encountered in the exhaust stream. Field strength is maximized to provide maximum electric field treatment of the EGR stream.

The second exhaust stream treated may be the main exhaust conduit leading to the sound muffler and in newest designs, a catalytic converter for the CI engine. The electret that supplies the electric field may be of the same material as the EGR system, with a filter-like structure element that consists of polyphenylene electret fibers that can withstand exhaust temperatures and retain field strength properties.

Application of the Invention to the Spark Ignition (SI) Internal Combustion Engine The pre-combustion fuel treatment of the fuel inlet is the same as discussed for the CI engine. The treatment of the nozzle, the nozzle-orifice section may be comprised of an insert of two dissimilar metals, copper and aluminum, located in the internal orifice of the injector nozzle. Alternatively, the dissimilar metals may be located on the external surface of the injector nozzle. The injector nozzle itself may be made of a Samarium Cobalt rare earth magnetic material for a second stage of fuel treatment. The electric field emanated by the dissimilar metals will treat the internal nozzle fuel flow stream with an electric field prior to injection into the intake manifold. The Samarium Cobalt nozzle will have fuel droplet dispersion orifices similar to a standard nozzle orifice diameter and configuration. The magnetic nozzle will project a magnetic field along its longitudinal axis through the sprayed fuel particles and into the intake manifold.

It is desirable to also project either a magnetic or electric field directly into the combustion chamber as is the case for the direct injection CI engine. This can be accomplished by adding either a magnetic field producing or electric field producing segment to the spark plug body. In one embodiment, an electret segment consisting of an inorganic electret made of porcelain is used. It can retain its field stability at a temperature encountered in the cylinder. The segment is added to the protruding section of the body of the spark plug section and is electrically insulated from the spark plug electrode. The electric field direction of this electret is along the longitudinal axis of the spark plug and projects into the cylinder. The modified spark plug with an electric field emanating into the cylinder provides an in-cylinder combustion treatment of the fuel/air mixture, first as a non-thermal plasma treatment and when combustion begins, a high temperature thermal plasma combustion treatment providing enhanced combustion.

The pre-combustion electric field air supply treatment is the same as described for the CI engine.

The exhaust stream of the SI engine is treated at two locations, the EGR stream and the exhaust stream in the conduit containing the catalytic converter. In one embodiment, the treatment of the EGR stream is by an electret element that emanates an electric field. The element is made of fibers in a filter-like structure made from polyphenylene polymer electret fibers. This electret polymer can withstand temperatures of 932° F. Field strength is maximized to provide maximum electric field treatment of the EGR stream.

The second exhaust stream treated is in the main exhaust conduit before the catalytic converter. In one embodiment, the element that supplies the electric field will be a polyphenylene polymer electret fiber made into a filter-like configuration. This polymer can withstand temperatures of 932° F. The exhaust gases flowing through the filter element consisting of electret fibers will be follow a flow path that subjects them to a maximum electric field.

Additional Applications of the Invention

The application of the present invention is not limited to the internal combustion engine, but also includes external combustion devices. With regard to external combustion, many applications have a fuel injection nozzle that injects fuel directly into a flame as opposed to the periodic fuel injection that occurs in an internal combustion engine.

In the present invention, the magnetic field producing nozzle directly sees the high temperature flame when used in flame or turbine combustor applications. Nozzle temperatures could exceed the Currie temperature of the magnetic material. The solution to this problem is to maintain the temperature of the nozzle, no higher than its materials of construction allows. First, the area of the nozzle that is in close contact with the flame can be kept to an absolute minimum by using high temperature insulating material such as a heat insulating ceramic collar. Magnetic fields can penetrate the insulating collar and will treat fuel particles as they exit the nozzle. Second, the nozzle can be kept cool by cooling or re-circulating the liquid fuel. Third, the nozzle body can be cooled by means of a cooling jacket or the attachment of a heat pipe. The temperature control of the nozzle would be accomplished by using these approaches or others that are well known in the heat transfer art.

The air supply to these combustion burners can be treated by components of the invention that are placed prior to the zone in which they are in contact with the excessive temperature of the flame. Insulating and cooling of these components may be accomplished with known heat transfer cooling designs similar to those used for the liquid fuel stream and well known in the heat transfer art.

The Jet engine application uses the nozzles of the invention for the primary engine feed, and also uses them in the afterburner section for military aircraft. The air in the compressor section can be treated in the same manner as described above when applying the invention to air superchargers. Both air and fuel can be molecularly enhanced prior to and during combustion in jet engine or gas turbine applications. The exhaust system can also be treated by the invention to reduce pollutants, while not exhibiting excessive back-pressure levels to which this engine type is sensitive.

Oil and gas residential and commercial burners, can also be treated by application of the invention to obtain higher combustion efficiency and reduced pollutants.

Coal fired burners in all areas of heat and power generation can be treated by application of the invention. Incinerators, especially those treating toxic compounds, will benefit from the enhanced combustion process of the invention.

Treatment of the exhaust stream of these stationary combustion applications can also be accomplished by application of the methods and apparatus of the invention.

Retrofit

The present invention may conveniently and economically retrofit existing internal combustion engines and achieve fuel savings and a horsepower increase and reduce exhaust pollutants. For the Diesel engine, replacing the fuel injectors with the new injector design of this invention would relatively easily achieve these goals. An air filter like device that exhibits either of the fields associated with the invention could also be easily added to the existing air intake duct system in conjunction with the injector change. Replacement costs will be recovered from fuel savings to pay for these modifications. Either field-producing device could be added to the exhaust gas return (EGR) duct. For Diesel powered vehicles, the addition of a pollutant reduction section in the exhaust system that utilizes the principles of the invention, along with the injector and air supply modification, would achieve the total of all possible results achieved by the invention. This revision could be accomplished at a reasonable cost and will allow this engine type to meet present and future regulated levels of pollutants in populated areas.

In the SI engine, like the CI engine, replacement of injectors that inject fuel into the intake manifold with those of the invention design would produce a significant improvement in engine performance. In addition, replacing the existing SI engine spark plugs with spark plugs that exhibit the embodiment of the invention would extend the fields of the invention into the cylinder like the CI engine configuration further achieving the objects of the invention. An air filter device that exhibits the design and fields associated with the invention could easily be added to the intake air duct to condition the air supply. Either field-producing device could be added to the exhaust gas return (EGR) duct. Application of the invention to the exhaust in this engine type would not be required to meet pollutant requirements; however, it would be desirable to achieve the lowest level of exhaust pollutants possible.

Other combustors such as Gas turbines, Jet engines, oil, gas, coal fired burners, and incinerator burner external combustion devices, can be adapted to include the concepts and designs of the invention. These adaptations can easily be carried out by those skilled in the art using the basic apparatus of the invention to obtain similar enhanced combustion and pollutant reduction results.

I claim:

1. A method for enhancing combustion of a fuel in a system having an injector body with a fuel inlet section, said method comprising:

placing a configuration having either a magnetic field component or an electric field component within the fuel inlet section, wherein said configuration has a fluted wall forming an annular space between said configuration and said fuel inlet section, whereby a film of fuel is forced to flow through said space.

2. The method of claim 1 wherein said magnetic field component is a permanent magnet of rare earth composition.

3. The method of claim 1 wherein said magnetic field component is selected from the group consisting of Samarium-cobalt, Alnico, Neodymium-iron-boron and electromagnets.

4. The method of claim 1 wherein said electric field component is an electret.

5. The method of claim 1 wherein said configuration comprises two metals that exhibit a standard potential difference, thereby creating an electric field.

6. The method of claim 5 wherein said metals are copper and aluminum.

7. A method for enhancing combustion of a fuel in a system having an injector body with a fuel inlet section, said method comprising:

placing a configuration having either a magnetic field component or an electric field component within the fuel inlet section, wherein said configuration is a porous filter-like construction.

8. The method of claim 7 wherein said electric field component is an electret.

* * * * *